US007594385B2

(12) United States Patent
Kriknoff

(10) Patent No.: US 7,594,385 B2
(45) Date of Patent: Sep. 29, 2009

(54) METHOD OF ASSEMBLING A METAL BRACELET

(75) Inventor: Serge Kriknoff, Carouge (CH)

(73) Assignee: G. & F. Chatelain S.A., La Chaux-de-Fonds (CH)

( * ) Notice: Subject to any disclaimer, the term of this patent is extended or adjusted under 35 U.S.C. 154(b) by 0 days.

(21) Appl. No.: 12/166,588

(22) Filed: Jul. 2, 2008

(65) Prior Publication Data

US 2009/0019890 A1 Jan. 22, 2009

(30) Foreign Application Priority Data

Jul. 17, 2007 (FR) ..... 07 05160

(51) Int. Cl.
*F16G 15/04* (2006.01)

(52) U.S. Cl. ..... 59/35.1; 59/31; 59/80; 63/4

(58) Field of Classification Search ..... 59/5, 59/31, 35.1, 78, 80, 88; 63/4
See application file for complete search history.

(56) References Cited

U.S. PATENT DOCUMENTS 3,969,949 A * 7/1976 Ohnishi ..... 59/35.1
4,067,188 A * 1/1978 Takahashi ..... 59/31
5,201,789 A 4/1993 Fontana
5,801,351 A * 9/1998 Ecoffet et al. ..... 59/31
6,318,064 B2 * 11/2001 Vandini ..... 59/80
7,201,687 B2 * 4/2007 Mott et al. ..... 59/88

FOREIGN PATENT DOCUMENTS

EP 0 968 670 A1 1/2000

* cited by examiner

*Primary Examiner*—David B Jones
(74) *Attorney, Agent, or Firm*—Frommer Lawrence & Haug LLP; Ronald R. Santucci

(57) ABSTRACT

The present invention relates to a method of assembling a metal bracelet (1) comprising two rows (2, 3) of outer elements assembled in pairs by pins (5) forming rigid links and at least one row (4) of intermediate elements mounted on the pins (5). The fixing of the pins (5) on the outer elements (2, 3) is carried out according to the following steps:

on the inside lateral face of each outer element two blind bores with a flat bottom and of diameter greater than the diameter of the pins are produced, smooth pins are chosen and they are inserted in said bores, after the intermediate elements have been previously mounted on said pins, the pins and the outer elements are transparency welded by carrying out a bombardment with an electron beam on the upper or lower wall of the outer elements, a finishing operation is carried out on the bombarded surface in order to remove the weld bead.

10 Claims, 1 Drawing Sheet

METHOD OF ASSEMBLING A METAL BRACELET

The present invention relates to a method of assembling a metal bracelet comprising two rows of outer elements assembled in pairs by pins forming rigid links and at least one row of intermediate elements situated between the outer elements and mounted on the pins in order to provide the connection between two successive links as well as to a bracelet manufactured by the implementation of the method.

DESCRIPTION OF THE PRIOR ART

Usually in metal bracelets comprising at least three rows of elements the pins which connect them transversely are force fitted into bores in the two outer rows or glued or fixed by solder or laser, etc. Such an assembly is not always aesthetically satisfactory and one or more pins can become detached from the corresponding elements. All of the pins can also be replaced by screws screwed into a tapping in one of the elements or by using a screw and a partially hollow pin with a tapping. This assembly is expensive.

SUMMARY OF THE INVENTION

The purpose of the present invention is to propose an assembly method overcoming the aforesaid disadvantages.

The method according to the invention is characterized in that the fixing of the pins on the outer links is carried out according to the following steps:

- on the inside lateral face of each outer element two axially offset blind bores with a flat bottom and of diameter greater than the diameter of the pins are produced,
- smooth pins are chosen and they are inserted in said bores, after the intermediate elements have been previously mounted on said pins,
- the pins and the outer elements are transparency welded by carrying out a bombardment with an electron beam on the upper or lower wall of the outer elements,
- a finishing operation is carried out on the bombarded surface in order to remove the weld bead.

Transparency welding through a metal wall by electron beam bombardment is known. However, when it is applied in the particular case of a blind bore certain problems arise. In fact, the air trapped in the bore, after having driven in the pin, heats up and has a tendency to escape through the molten metal mass under the effect of the electron beam bombardment. It thus creates air bubbles in the metal mass which are prejudicial to the quality of the weld if they remain inside or they deform the weld bead on the surface by creating holes and the machining is difficult.

The method according to the invention makes it possible to eliminate these problems. In fact, the flat bottom of the blind bore makes it possible, unlike with the usual bores of conical shape, to eliminate or to greatly reduce the air pocket which would remain at the bottom of the bore. The diameter of the bore greater than the diameter of the pin allows the air to escape during the positioning of the pin and, as a secondary consideration, the air remaining and heated up during the welding can also escape from the bore without going into the molten mass. In this way there is obtained on the bombarded surface of the element a weld bead forming a reduced excess thickness of material which can easily be removed by a finishing operation. The small excess thickness also contributes to the loss of material being low. The regularity of the weld bead and its thinness make it possible to eliminate all visible traces of welding by means of a simple finishing operation.

According to a preferred variant, after the tapping, said elements are subjected to a tumbling operation in order to remove burrs, followed by a cleaning operation to eliminate all traces of powder.

In fact, after the formation of the traversing bores for the intermediate elements and blind bores for the outer elements, the burrs are eliminated by tumbling. Given that metallic powders become deposited on the elements, a cleaning operation is carried out in order to remove them. The cleaning consists of washing in a liquid because it is important to eliminate the metallic powders formed during the tumbling because they have a negative effect on the transparency welding.

According to another variant embodiment, the intermediate elements are also welded onto the pins by transparency.

If solely the outer elements are welded onto the pins an articulated bracelet is obtained; a rigid bracelet is obtained by also welding the intermediate elements onto the pins.

The invention also relates to a bracelet manufactured by the implementation of the method, characterized in that said bracelet is a watch bracelet and, for a few links, the bores are traversing and the pins are replaced by screws to allow the length adjustment of the bracelet.

In fact, in order to allow the length adjustment of the bracelet to adapt it to the circumference of the user's wrist, it is necessary to provide, as usual, a few links in which the pins are replaced by screws.

According to a variant, the metal used for the elements and the pins is either steel or gold or titanium.

DESCRIPTION OF THE DRAWING

The invention will be described in more detail with reference to the appended drawing.

DESCRIPTION OF THE PREFERRED EMBODIMENT

Figure 1:
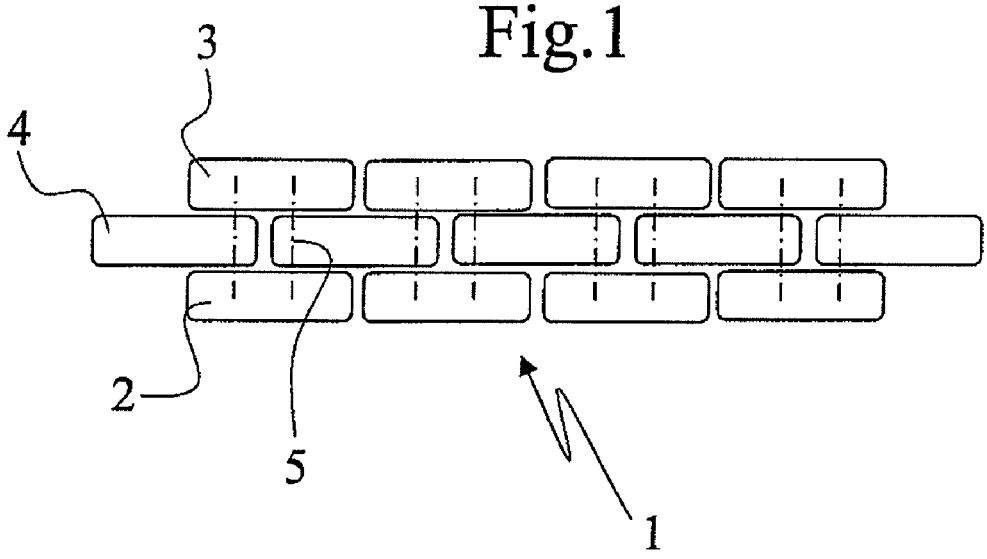
FIG. 1 is a partial view of a bracelet with three rows of elements.

In FIG. 1 a portion of an articulated bracelet 1 is shown. It consists of three rows of elements including two outer rows and one inner row. The number of inner rows can be greater than one. The elements 2 and 3 of the outer rows are transversely connected by pins 5 which are fixed by welding in two blind bores with which the outer elements 2 and 3 are provided. The inner elements 4 are provided with traversing bores and are articulated on the pins 5 (diagrammatically represented by their axes in FIG. 1) freely in rotation with respect to the outer elements 2 and 3.

Figure 2:
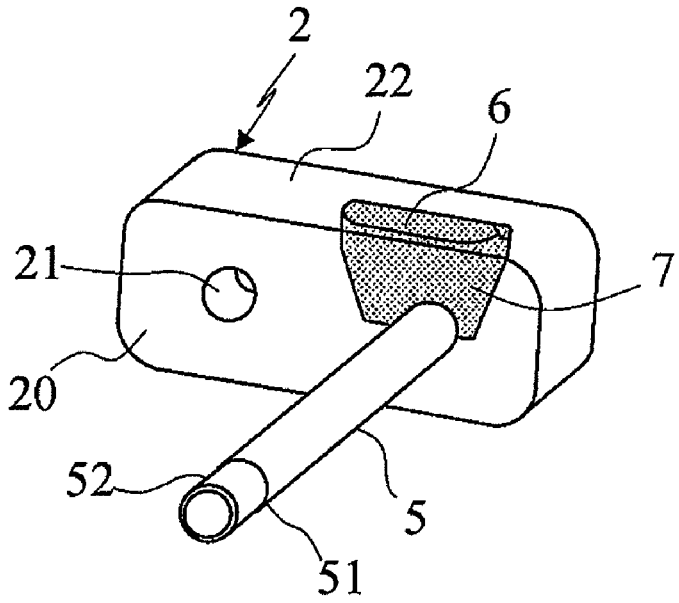
FIG. 2 shows an outer element with a pin after the welding.
Figure 3:
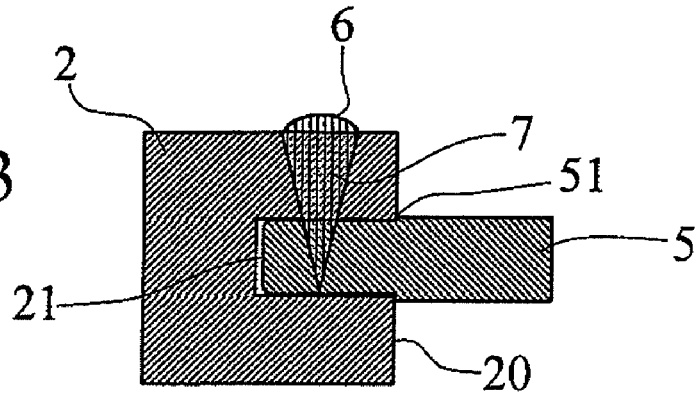
FIG. 3 is a cross-sectional view through the longitudinal axis of the pin shown in FIG. 2.

The welding of a pin 5 onto an element 2 will be described with reference to FIGS. 2 and 3.

Each outer element 2 (or 3) is provided, on its internal lateral face 20, with two blind bores 21 with a flat bottom. The diameter of the bore is slightly greater than the diameter of the end of a pin 5. This difference is of the order of 0.03 mm. Each smooth pin has two shoulders 51. The diameter of the pin 5 between the two shoulders is greater than the diameter of the bores 21 in order to provide a fixed spacing between the elements 2 and 3, because the depth of the bores 21 can possibly vary. An identical spacing between the two elements 2 and 3 is ensured by inserting the pins 5 into the bores 21 until the shoulders 51 bear against the faces 20. During the insertion of the ends 52 of the pins 5, of diameter less than the diameter of the bores 21, the air contained in the bores 21 is expelled to the exterior due to this difference in diameters. The flat bottom of the bores also limits the air which can remain at the bottom of the bore in comparison with a conical bottom, if the end of the pin does not come into contact with the bottom.

After having inserted the pins 5 into the bores, an electron beam bombardment is applied on the upper face 22 (or lower face) of the elements 2 and 3 making it possible to weld, by transparency, the ends of the pins 5 in the bores 21. In FIGS. 2 and 3 can be seen the part 7 of the element 2 and of the pin 5 melted under the effect of the transparency welding as well as the excess thickness 6 remaining at the end. This excess thickness 6 or weld bead can be removed by a finishing operation, the excess thickness being between 0.05 and 0.15 mm. During the transparency welding, the air which is in the bore and which expands due to the released heat is also expelled to the exterior without having a tendency to pass through the molten mass.

Before proceeding with the transparency welding, the various elements of the bracelet 1 are assembled, as shown in FIG. 1 and then the electron beam bombardment on the elements 2 and 3 is carried out.

In order to allow the adjustment of the bracelet, in particular for watch bracelets, a few elements having the same arrangement but having traversing bores are added at the ends of the bracelet and screws are used instead of pins.

After having formed the bores in the elements 2, 3 and 4, it is desirable to eliminate the burrs. For this purpose the elements are subjected to a tumbling operation. The elements are placed in a container containing steel elements such as balls or similar elements and subjected to a series of vibrations. The burrs are eliminated by the friction between the steel elements and the elements of the bracelet. This friction eliminating the burrs creates metal powders which are removed by washing.

The metal used for the elements 2, 3 and the pins is either gold or steel or titanium, it being understood that the same metal is used for the elements and for the pins.

After the welding, an operation of washing the bracelet may also be necessary in order to eliminate traces of metal vapor (black smudges) produced during the welding operation.

If it is desired to obtain a rigid bracelet a transparency welding is also carried out on the intermediate elements in order to rigidly connect them to the pins.

The invention claimed is:

1. A method of assembling a metal bracelet comprising two rows of outer elements assembled in pairs connected by smooth pins forming rigid links and at least one row of intermediate elements situated between the outer elements and mounted on the pins in order to provide the connection between two successive links, wherein the pins are affixed to the outer elements according to the following steps:

on an inside lateral face of each outer element two axially offset blind bores with a flat bottom and of diameter greater than a diameter of the pins are produced, the pins are inserted in said bores, after the intermediate elements provided with two traversing bores have been previously mounted on said pins, the pins and the outer elements are transparency welded by carrying out a bombardment with an electron beam on a face of the outer elements, a finishing operation is carried out on the bombarded face.

2. The method as claimed in claim 1 wherein, after providing the bores, said elements are subjected to a tumbling operation in order to remove burrs, followed by a cleaning operation.

3. The method as claimed in claim 1, wherein the Intermediate elements are also welded onto the pins by transparency welding.

4. A bracelet manufactured by the implementation of the method as claimed in claim 1, wherein said bracelet is a watch bracelet and, for at least one link, the bores are traversing and the pins are replaced by screws to allow a length adjustment of the bracelet.

5. The bracelet as claimed in claim 4, wherein said outer elements and inner elements constituting the bracelet and the pins are made of steel.

6. The bracelet as claimed in claim 4, wherein said outer elements and inner elements constituting the bracelet and the pins are made of gold.

7. The bracelet as claimed in claim 4, wherein said outer elements and inner elements constituting the bracelet and the pins are made of titanium.

8. The method as claimed in claim 2, wherein the intermediate elements are also welded onto the pins by transparency welding.

9. A bracelet manufactured by the implementation of the method as claimed in claim 2, wherein said bracelet is a watch bracelet and, for at least one link, the bores are traversing and the pins are replaced by screws to allow a length adjustment of the bracelet.

10. A bracelet manufactured by the implementation of the method as claimed in claim 3, wherein said bracelet is a watch bracelet and, for at least one, the bores are traversing and the pins are replaced by screws to allow a length adjustment of the bracelet.

* * * * *